US006735998B2

(12) United States Patent
Mitchell

(10) Patent No.: US 6,735,998 B2
(45) Date of Patent: May 18, 2004

(54) METHOD OF MAKING METAL BALL BATS

(75) Inventor: George A. Mitchell, Poland, OH (US)

(73) Assignee: George A. Mitchell Company, Youngstown, OH (US)

( * ) Notice: Subject to any disclaimer, the term of this patent is extended or adjusted under 35 U.S.C. 154(b) by 0 days.

(21) Appl. No.: 10/264,425

(22) Filed: Oct. 4, 2002

(65) Prior Publication Data

US 2004/0065134 A1 Apr. 8, 2004

(51) Int. Cl.[7] ..... B21C 37/16
(52) U.S. Cl. ..... 72/370.25; 72/276
(58) Field of Search ..... 72/274, 276, 370.14, 72/370.16, 370.24, 370.25

(56) References Cited

U.S. PATENT DOCUMENTS

| | | | | |
|---|---|---|---|---|
| 1,611,858 A | | 12/1926 | Middlekauff | |
| 2,095,563 A | * | 10/1937 | Cowdery | 72/276 |
| 2,240,456 A | | 4/1941 | Darner | |
| 2,340,156 A | | 1/1944 | Taylor | |
| 3,479,030 A | | 11/1969 | Merola | |
| 3,572,080 A | | 3/1971 | Alexoff | |
| 3,691,625 A | | 9/1972 | Swenck | |
| 3,735,463 A | | 5/1973 | Merola | |
| 3,841,130 A | | 10/1974 | Scott | |
| 3,854,316 A | | 12/1974 | Wilson | |
| 4,089,199 A | | 5/1978 | Siemonsen | |
| 4,616,500 A | | 10/1986 | Alexoff | |
| 4,961,576 A | | 10/1990 | Meredith | |
| 5,074,555 A | * | 12/1991 | Meredith | 72/370.24 |
| 5,626,050 A | | 5/1997 | Ploughe et al. | |

* cited by examiner

*Primary Examiner*—Lowell A. Larson
(74) *Attorney, Agent, or Firm*—Clifford A. Poff

(57) ABSTRACT

A method for draw forming a desired contour to the outer diameter of a tubular workpiece provides that the selected workpiece have a wall thickness uniform throughout its length or a combination of uniform thicknesses at end portions with a mid portion of a tapering wall thickness. The outer diameter of selected workpiece is reduced along essentially only a part of the starting tubular metal blank by drawing the metal blank only partly through a contoured die or only partly through each one of a succession of contoured dies.

16 Claims, 4 Drawing Sheets

METHOD OF MAKING METAL BALL BATS

BACKGROUND OF THE INVENTION

1. Field of the Invention

This invention relates to a method of draw forming a desired contour along outer diameter of a tubular workpiece, and more particularly, to such a method for controlling and minimizing an unwanted increase to the wall thickness along the altered contours of the tubular workpiece useful particularly to form a metal ball bat or similarly formed tubular metal workpiece having contours to meeting stringent shape and wall thickness requirements.

2. The Prior Art

While not so limited, the present invention is particularly useful to provide a workpiece for the manufacture of metal ball bats although equally useful to provide a workpiece for the manufacture of contoured components of structural assemblies such as bicycles frames of the type needed for light weight and high strength sports bicycles. The methods of manufacturing ball bats and improvements in the design and materials have been the subject of numerous patents over the past 100 years, most directed to ball bats used in games of baseball and softball. The baseball bat was initially made of hardwood and, to this day, ball bats used in professional baseball leagues are exclusively made of hard woods. Over the years, there has been a great increase in the number of ball bats to meet the demand for the vastly increasing popularly of the sport particularly semi professional, college, and little league baseball and softball organized leagues. There has been a search for better materials to make the ball bat particularly due to a shortage of appropriate hard wood to make baseball bats and the relatively short vulnerable life of the wooden bat. An early approach was to select metal as an alternative material for the hard wood material. U.S. Pat. No. 1,611,858 issued in 1926 in the name of L. Middlekauff discloses a ball bat made from a tapered steel tube, which can be formed by a rolled tapered sheet with mating edges joined along a seam line to form the tube. U.S. Pat. No. 2,340,156 issued in 1944 in the name of T. Taylor discloses a cast construction for a ball bat with thin sidewalls reinforced by ribs longitudinally throughout the length of the bat.

Thereafter, the patent art concentrated on seamless lightweight metal tubing such as aluminum, titanium as the usual and most suitable as a starting material. However, after further experimentation and investigations into various methods of producing ball bats from lightweight metal tubing, one overall requirement existed, namely, the metal bat must closely resemble the operating characteristics of a wood bat. Specifically, the metal bat must exhibit the weight distribution; the feel and sound of the wood bat when hitting a ball. In the final forming of the metal tube into the characteristic outside contour of the ball bat, a rotary swaging process was commonly used for the required metal working operations. As an alternative, U.S. Pat. No. 5,626,050 issued in the name of T. Ploughe discloses the characteristic contour for a metal bat can also be produced by the cold pilger process. The forming operations to achieve the characteristic bat contour by the rotary swaging process or cold pilger process both involved reducing of the outside diameter of the metal tube by applying radially inward compressive forces along the selected length of the metal tube. These radially applied compressive forces also operate to thicken the wall section of the reduced outside diameters of the tube generally in direct proportion to the diameter decrease. U.S. Pat. No. 3,479,030 issued in the name of A. Merola describes that this wall thickening adversely affects the balance and weight distribution along the elongation to the length of the ball bat as compared to a wood bat. U.S. Pat. No. 3,854,316 issued in the name of R. Wilson and the cold pilger process disclosed in U.S. Pat. No. 5,626,050 issued in the name of T. Ploughe disclose counteracting the wall thickening accompanying the diameter reduction by inserting contoured mandrels in the cavity of the tube during the rotary hammer swaging operation and cold pilger process, respectively. The use of the internal mandrel is useful to control the tube wall thickening but significantly added to the metal working costs and greatly increased the stress in the machinery used to reduce the outside diameter of the tube.

The starting of the metal bat forming operation with a variable wall tube blank was proposed as a measure to counteract the wall thickening of the metal tube along the tube length where the reduction to the outside wall diameter occurred. The required variable wall thickness and its location along the metal tube blank so as to result in the desired wall thickness after outside contour forming has been proposed to be accomplished in several ways. U.S. Pat. No. 3,841,130 issued in the name of I. Scott disclosed machining the outside of the metal tubular blank prior to forming of the tube. U.S. Pat. No. 3,807,213 issued in the name of Willis et al and U.S. Pat. No. 4,089,199 issued in the name of F. Siemonsen disclose cold forming a tube blank over a contoured mandrel for producing the desired results of a metal blank with a constant outside diameter and variable wall thickness blank. U.S. Pat. No. 2,240,456 in the name of F. Damer discloses the use of a tapered manipulating mandrel for drawing multiple lengths, constant outside diameter blanks with varying wall thicknesses. Starting blanks with variable wall thicknesses generally solve the problem of controlling the wall thickness and the location of changing wall thickness along the length of the finished ball bat. However, the metal working operation to produce the final outside contour was usually a rotary swaging process which is slow and labor intensive. The radial compressive forces generated by the rotary swaging process create a hardening of the metal along the reduced outside diameter section of the bat especially in the handle area. In the case of aluminum alloys chosen for their hardness for higher performance more costly bats, the hardening of the aluminum metal was so great that the rotary swaging operation to form the required outside contour of the bat required two swaging passes separated by an intermediate annealing operation to insure that the metal did not crack or break during the rotary swaging process.

The present invention seeks to avoid the disadvantages arising out of the use of the rotary swaging and cold pilger processes by the use of drawing a blank only partly through a contoured die or a succession of contour dies. The drawing process operates to reduce the diameter of the metal tubular blank which greatly reduces increases to the tubular walls undergoing the reduction to the diameter particularly as compared to the unwanted thickness increases to the tubular walls when acted on by the rotary swaging or the cold pilger processes. An additional advantage arising out of the use of the contoured dies for draw forming a starting tubular blank is the fact that the drawing operations produce considerably less work hardening of the metal forming the tubular blank. Because of the presences of tension forces for the size reduction operation to such a beneficial extent that the outside diameter of a desired finished ball bat contour can be produced, in most cases, without the need for an intermediate annealing operation even when the tubular metal blank is comprised of alloys exhibiting harder physical properties of aluminum. Thus, the present invention provides the advantage that intermediate annealing can be usually eliminated. The drawing method of the present invention can produce an acceptable product using a constant wall thickness starting blank especially for the lower performance bats. When a thinner tube wall is required in the handle and transition sections of a ball bat than can be produced from a constant wall starting tubular blank, the thinner wall thicknesses can be achieved by starting with a variable wall thinner metal starting blank. The requirement for thinner tube wall exists for the higher performance, more costly ball bats.

It is an object of the present invention to provide a process for reducing the diameter of essentially only a select length of a tubular metal blank by the use of tension applied to pull the metal blank in a die or a succession of dies so that the reduction to the diameter of the tube is accompanied by a minimum of thickening to the wall thickness and which can be enhanced by the selection of a starting blank with a select tapering wall thickness.

It is a further object of the present invention to provide a draw forming operation for a tubular metal blank wherein the succession of drawing operations is used to produce a desired contour without the need for intermediate annealing particularly with workpieces comprised of aluminum or aluminum alloys.

It is still another object of the present invention to provide a drawing operation to use contour dies to produce a product suitable for forming a ball bat high performance characteristics arising out of the formation of thin wall sections enhanced by the selection of a starting blank having a variable thickness wall.

It is another object of the present invention to provide a draw forming operation for a ball bat or similar workpiece wherein multiple drawing operations are performed with the second and any additional drawing operation being controlled by limiting the tension forces applied to the metal blank with such forces being resisted by the contour of the die used for the drawing operation.

SUMMARY OF THE INVENTION

In accordance with the present invention there is provided a method of making a contoured outer diameter of a metal ball bat, the method including the steps of; selecting a starting tubular metal blank, and reducing an outer diameter of essentially only a part of the starting tubular metal blank by drawing the metal blank only partly through a contoured die or only partly through each one of a succession of contoured dies.

BRIEF DESCRIPTION OF THE DRAWINGS

These features and advantages of the present invention as well as others will be more fully understood when the following description is read in light of the accompanying drawings in which.

DETAILED DESCRIPTION OF THE INVENTION

Figure 1:
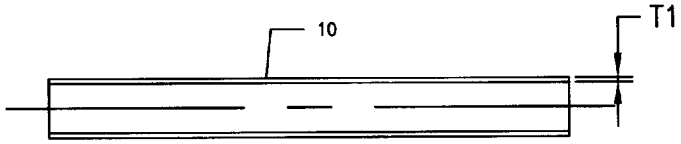
FIG. 1 is an illustration of a tubular blank taken as a longitudinal section showing a constant wall thickness.
Figure 2:
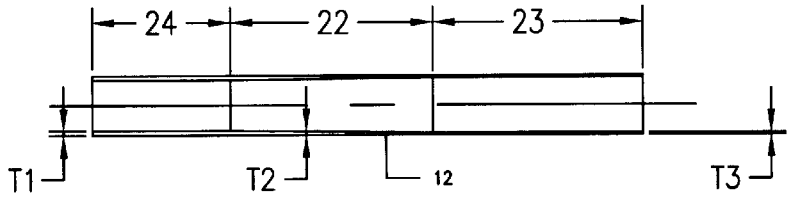
FIG. 2 is an illustration of a tubular blank taken as a longitudinal section showing a variable wall thickness along the length of the blank.

FIGS. 1 and 2 illustrate two suitable starting tubular metal blanks 10 and 12 for use in metal drawing operations according to the method of the present invention for producing a desired contoured external surface for a metal ball bat. It is within the scope of the present invention to select the metal blank 10 or 12 from any suitable ferrous or nonferrous metal preferably aluminum or aluminum alloy. The tubular metal blank 10 of FIG. 1 is notably characterized by a uniform wall thickness T1 throughout the entire length of metal blank. The wall thickness is selective to correspond to the desired wall thickness of the barrel portion 14 of a completed metal ball bat 16 shown in FIG. 3. The barrel portion 14 is substantially unaltered during the various metal working operations and unaltered by the particular drawing operations used to produce the transition portion 18 and the handle portion 20 of the ball bat. The drawing operations utilized to form the transition and handle portions produce a generally small increase to the tapered wall thickness T4 along the final contour of the transition portion 18 and a slightly larger increase producing a the final wall thickness T5 along the final contour of the handle portion 20. In the past, reductions to the diameter of the metal blank by rotary swaging or by the pilger process produce such a significant increase, i.e. between 80% and 100% increase, to the wall thickness of the metal blank due to the metal working operation, which is relatively significant in the production of low performance bats and even more significant for the production of high performance bats. According to the preferred embodiment of the present invention, the thickness T4 and T5 as compared to the thickness T1 are generally in the range of 25% to 30% more than thickness T1. When it is desired to produce a high performance bat, the present invention provides that the starting tubular metal blank 12 as shown in FIG. 2, have a variable wall thickness, generally identified by reference character T2, continuously tapering along an intermediate length 22 which comprises the transition from a relatively thin constant wall thickness of T3 along the length of an end portion 23 opposite to a relatively thicker constant wall thickness of T1 along the length of the opposite end portion 24. As described hereinbefore the accomplishment of providing a required variable wall thickness and its location along the metal tube blank is per se well known and shown in the identified prior patents. Thus, the variable wall thickness blank can be produced either by forcing a constant wall thickness starting blank through a forming die along a full length internal and longitudinally tapered mandrel or by drawing a constant wall starting blank through a forming die over a foreshorten length of an internal tapered and reciprocated mandrel.

The end portion 24 will comprise the barrel portion of the finished ball bat. The portions 22 and 23 of the tubular metal blank undergoing reduction to the diameter by drawing operations according to the method of the present invention. The taper to the wall thickness along length 22 is a variation to the wall thickness along the part of the metal blank subject to the drawing operation of the present invention and the magnitude of the taper is chosen so that the increase to the wall thickness along the transition portion 18 and handle portion 20 caused by the drawing operation or operations of the present invention is sufficient to yield final wall thicknesses to correspond to essentially the same wall thickness of the barrel portion 14. In this way the wall thickness along the entire length of the ball bat is substantially uniform to provide the high performance characteristics desired by the industry.

Figure 4A:
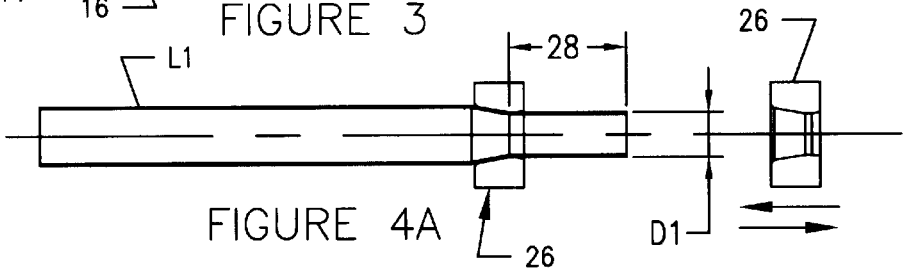
FIGS. 4A, 4B and 4C are a sequence of illustrations depicting blank pointing of a selected tubular metal blank.
Figure 4B:
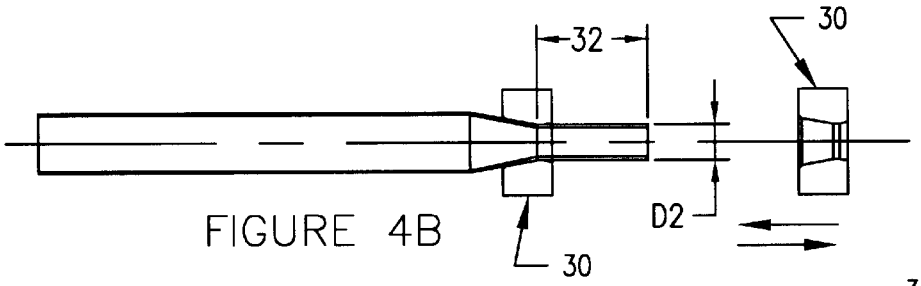
Figure 4C:
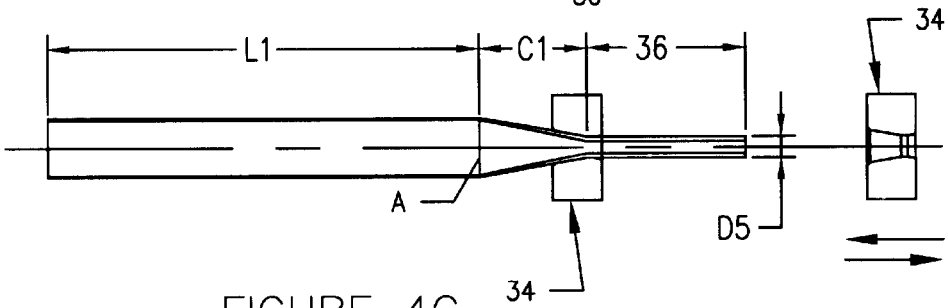
Figure 5A:
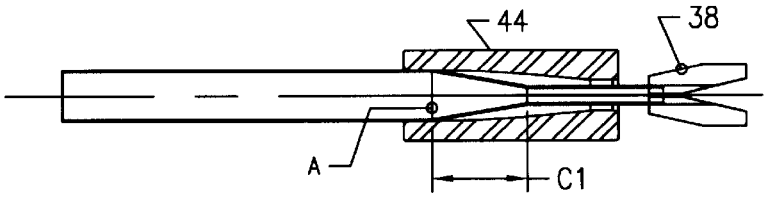
FIGS. 5A, 5B, 5C and 5D are sequential illustrations showing the use of contoured dies for producing a tapered and handle portions of a ball bat according to the preferred embodiment of the present invention.
Figure 5B:
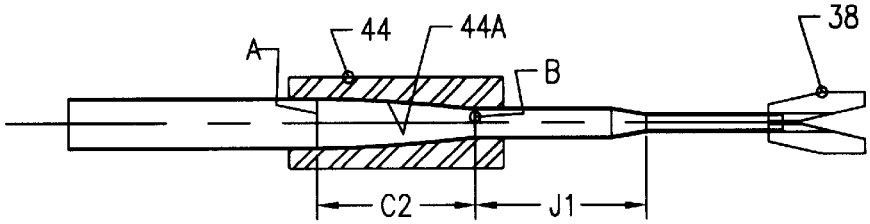
Figure 5C:
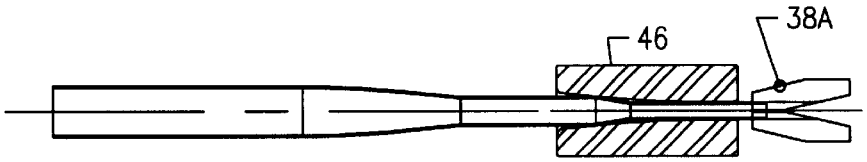
Figure 5D:
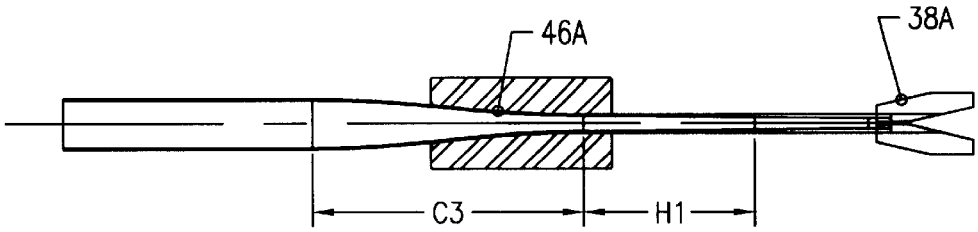
Figure 6:
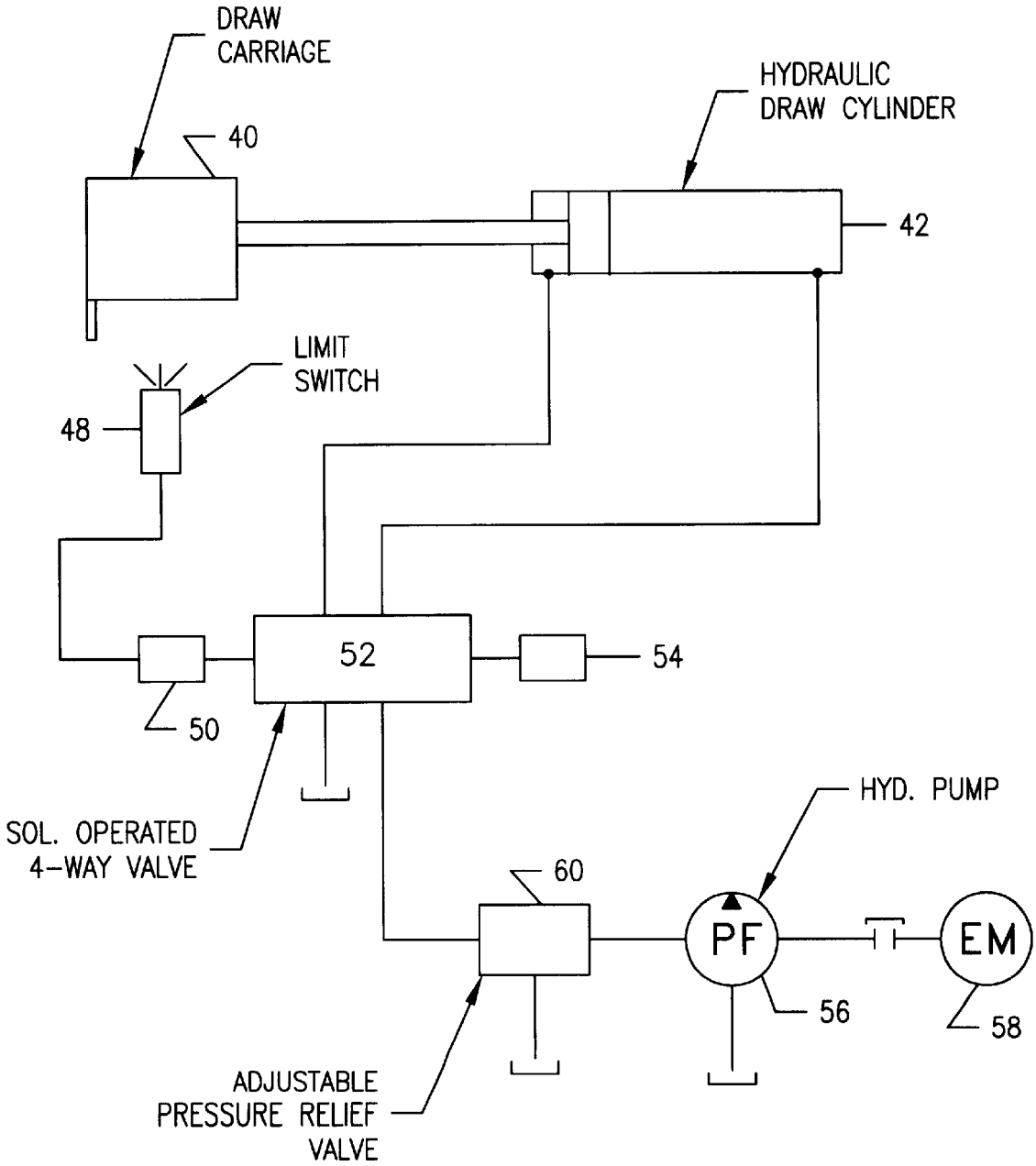
FIG. 6 is a schematic illustration of a hydraulic circuit associated with a draw carriage for pulling a workpiece partly through a contour die according to the preferred embodiment of the present invention.

FIGS. 4A, 4B, and 4C schematically illustrate preliminary metal forming operations used to form a reduced end portion on the selected metal blank by multiple push point reduction to a short length of the blank. A push point die 26 reduces a first length 28 of the blank to an initial reduced diameter D1. The next push point reduction uses a die 30 to further reduce the diameter D1 to a diameter D2 and increasing the length of the reduced portion 32. Additional push pointer dies may be used until a final die 34 is used to produce a final desired diameter D5 along the length 36, which is suitable for engagement, by grippers 38 shown in FIGS. 5A, 5B, 5C and 5D according to a preferred embodiment of the present invention. An alternative to using dies for the push pointing operations, it is within the scope of the present invention to utilize rotary swaging process per se well known in the art to reduce the diameter of an end portion of a starting workpiece to the final desired diameter D5 along the length 36 for engagement by the gripper 38. The grippers 38 are part of drawing machinery, per se well known in the art with the exception that as shown in FIG. 6 each gripper is incorporated into a draw carriage 40 that is reciprocated by a hydraulically powered piston and cylinder assembly 42. The initial tube drawing operation according to the method of the present invention uses a position control for the piston and cylinder assembly 42 to establish the length of tubular blank that is drawn through the first die 44 of at least two consecutively used dies the second being die 46, which are shown in FIGS. 5A and 5C. The position control takes the form of a limit switch 48 strategically located along the path of travel by the draw carriage to establish a predetermined length of workpiece that is drawn through the contoured walls 44A of the die 44. The limit switch when operated by contact with the carriage 40 delivers an electrical signal to a solenoid or other suitable controller 50 for operating a four-way valve 52 in a direction to stop linear movement of the hydraulic piston in cylinder assembly 42. The valve 52 is shifted by a solenoid 54 in a direction opposite to the displacement of the valve by solenoid 50. The valve 52 is supplied with pressurized hydraulic fluid from a pump 56 driven by a motor 58, with the fluid pressure being controlled by an adjustable pressure relief valve 60. The valve 60 is operatively used for the second and any further tube drawing steps for limiting the tension applied to the tube surface in contact with the contoured surfaces 46A of die 46.

The tube pointing operations of a selected tubular blank establish a transverse plane A at the intersection of a constant diameter tube length L1 and a truncated conical tube length C1. The selected metal blank supplied from the push pointing operation of FIGS. 4A–4C is then inserted and advanced initially along the contoured die 44 cavity to a point where truncated conical portion C1 wholly resides in the die cavity and transverse plane A makes a first seating contact with the contoured die surface. Piston and cylinder assembly 42 is then operated in a direction to pull the tubular workpiece partly through the die and establishing as shown in FIG. 5B and elongated truncated conical length C2 terminating at a transverse plane B from which the transitional length J1 emerges from the die. The length of the truncated conical section C2 and J1 are established by the limit switch 48 as well as a sufficient length of the starting tubular blank to form the barrel portion 14 of the ball bat 16.

Figure 3:
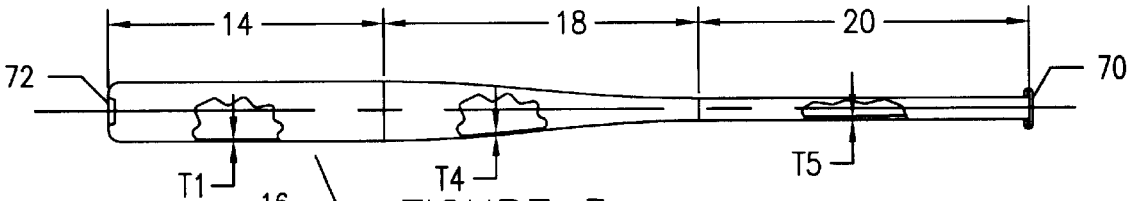
FIG. 3 is an illustration of a typical ball bat containing designations of wall thicknesses and component sections.
Figure 7:
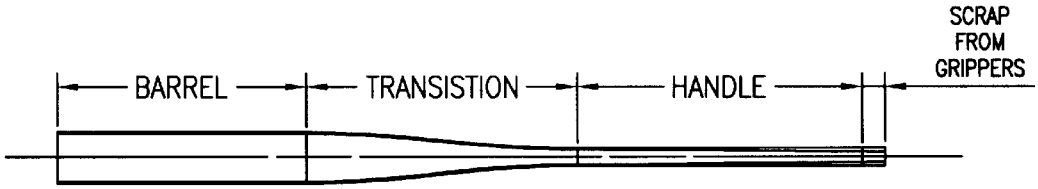
FIG. 7 is an illustration of a ball bat in semi-finished form after the drawing operations shown in FIGS. 5A–5D.

The partly drawn workpiece is then removed from the die 44 by reversing the direction of movement of the drawn end portion of the workpiece to the extent necessary that the workpiece is passed free and clear of the die cavity 44A so that the workpiece can then be removed from the die 44 upon release from the gripper 38. The partly drawn workpiece is then inserted and advanced initially along the contoured die cavity 46A to a point where the transitional length J1 only partly resides in the die cavity and a transverse plane B resides at a spaced distance from a constant diameter section at the exit end of the contour die surface. A gripper 38A of a second draw carriage then engaged with the end portion of the drawn workpiece emerging from the exit end of the die. As just described, this relationship of the partly drawn workpiece to the contoured die surface 46A of die 46 is illustrated in FIG. 5C. The next step in the present invention comprises a further drawing operation by operating the piston and cylinder assembly 42 in a direction to pull the partly drawn tubular workpiece again only partly through the die 46 and establishing as shown in FIG. 5D a final desired truncated transition section C3 with a constant diameter handle portion having a length H1 extending partly from the die. The piston is operated on by fluid pressure whose magnitude is limited by adjustments performed on the adjustable pressure relief valve 60. By this operation of the drawing procedure, the transition portion, shown in FIG. 7, is formed with an external tapered surface free of the transverse plane B that previously existed between the truncated conical portion C2 and the transitional length J1. The barrel portion remains unaltered by the operation of die 46 while the handle portion is drawn from the die with a constant diameter. Usually the grippers 38A and 38 engage a short end portion beyond the length of the finished handle and at the option of the manufacturer the short end portion may be discarded or allowed to remain as part of the handle. As will be now understood by one skilled in the art, more than two contoured dies maybe required to form a workpiece having hardness characteristics and dimensional requirements to form a finished ball bat as shown in FIG. 3. Additionally, as shown in FIG. 3 the final construction of a ball bat includes the addition of an end cap 70 at the terminal end of the handle portion 20 and an end plug 72 at the terminal end portion of the barrel 14.

Figure 8A:
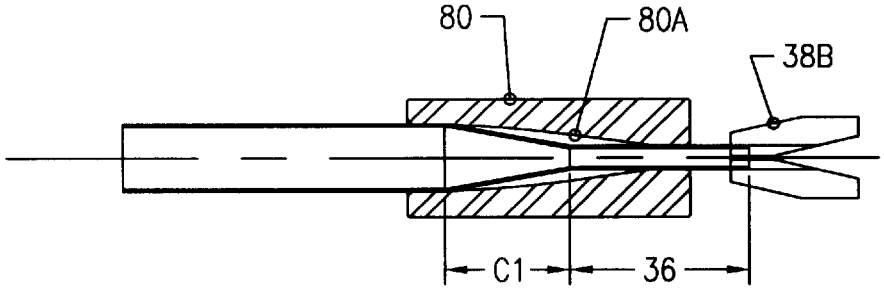
FIGS. 8A, 8B, and 8C are sequential illustrations showing the use of contoured die for producing a tapered and handle portions of a ball bat according to a second embodiment of the present invention.
Figure 8B:
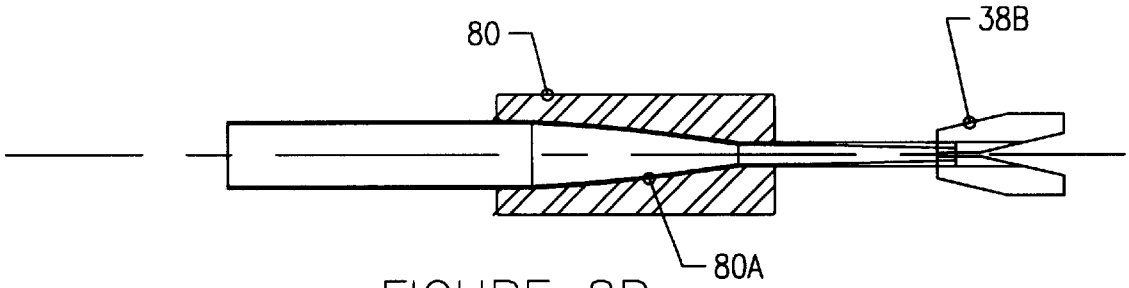
Figure 8C:
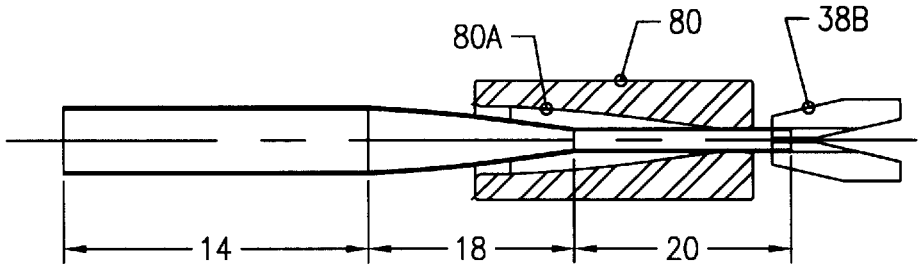

A second embodiment of the present invention is shown in FIGS. 8A, 8B and 8C and essentially involves a method of forming a bat using only one contour die 80 having a contoured die surface 80A. As in the preferred embodiment of the present invention, the second embodiment uses a selected elongated tubular metal blank which can be as described and shown in FIGS. 1 and 2. The selected tubular blank is initially subject to the tube pointing operations as shown and described in regard to FIGS. 4A, 4B and 4C where upon the pointed end of the tubular blank is inserted into the contoured cavity of the die 80 and the inserted workpiece comes to rest at a position shown in FIG. 8A where transverse plane A resides at the entrance to a truncated conical portion of the contoured die surface 80A and the truncated conical tube length C1 wholly resides in the cavity of the die. The final diameter D5 has an end portion emerging from the die for gripping contact with gripper 38B. Piston and cylinder assembly 42 coupled to the draw carriage advances the gripper in a direction to pull the tubular blank into the die sufficiently to wholly form the transition section with a length corresponding to the desired length for a ball bat and a handle portion with a constant diameter. The workpiece is then pushed from the die in opposite direction sufficiently to remove the handle portion from the die, with the gripper 38B previously disengaged. A ball bat made according to the method the second embodiment of the present invention will principally be comprised of a relatively short length to avoid overstressing the workpiece during the application of tension forces for the draw forming of the reduced diameter portions.

While the present invention has been described in connection with the preferred embodiments of the various figures, it is to be understood that other similar embodiments may be used or modifications and additions may be made to the described embodiments for performing the same function of the present invention without deviating there from. Therefore, the present invention should not be limited to any single embodiment, but rather construed in breadth and scope in accordance with the recitation of the appended claims.

What is claimed is:

1. A method of making a contoured outer diameter of a metal ball bat, said method including the steps of: selecting a starting tubular metal blank having a constant outside diameter substantially the same outside diameter as desired for the body portion of a finished ball bat and wherein said starting tubular metal blank has a constant wall thickness substantially the same as the wall thickness desired for the body portion of said finished ball bat; and reducing an outer diameter of essentially only a part of said starting tubular metal blank by drawing the metal blank only partly through a contoured die or only partly through each one of a succession of contoured dies.

2. The method according to claim 1 including the further step of reducing an end portion of said starting tubular metal blank to an outside diameter approximating the desired outside diameter of a handle portion of said finished ball bat.

3. The method according to claim 2 wherein said step of reducing an end portion includes push pointing said starting tubular metal blank to a desired outside diameter of a handle portion of said finished ball bat.

4. The method according to claim 2 wherein said step of reducing an end portion includes rotary hammer swaging said starting tubular metal blank to a desired outside diameter of a handle portion of said finished ball bat.

5. The method according to claim 1 wherein said starting tubular metal blank is aluminum or aluminum alloy.

6. A method of making a contoured outer diameter of a metal ball bat, said method including the steps of: selecting a starting tubular metal blank with a variable wall thickness beginning at a predetermined site; and reducing an outer diameter of essentially only a part of said starting tubular metal blank by drawing the metal blank only partly through a contoured die or only partly through each one of a succession of contoured dies beginning at said predetermined site for reducing an outer diameter to concurrently produce a thickening to the wall thickness sufficiently to substantially correspond to a desired constant wall thickness for said finished ball bat.

7. The method according to claim 6 including the further step of reducing an end portion of said starting tubular metal blank to an outside diameter approximating the desired outside diameter of a handle portion of said finished ball bat.

8. The method according to claim 7 wherein said step of reducing an end portion includes push pointing said starting tubular metal blank to a desired outside diameter of a handle portion of said finished ball bat.

9. The method according to claim 7 wherein said step of reducing an end portion includes rotary hammer swaging said starting tubular metal blank to a desired outside diameter of a handle portion of said finished ball bat.

10. The method according to claim 6 wherein said starting tubular metal blank is aluminum or aluminum alloy.

11. A method of making a contoured outer diameter of a metal ball bat, said method including the steps of: selecting a starting tubular metal blank including forming a variable wall thickness blank by forcing a constant wall thickness starting blank through a forming die along a full length internal and longitudinally tapered mandrel; and reducing an outer diameter of essentially only a part of said starting tubular metal blank by drawing the metal blank only partly through a contoured die or only partly through each one of a succession of contoured dies.

12. A method of making a contoured outer diameter of a metal ball bat, said method including the steps of: selecting a starting tubular metal blank including forming a variable wall thickness blank by drawing a constant wall starting blank through a forming die over a foreshorten length of an internal tapered and reciprocated mandrel; and reducing an outer diameter of essentially only a part of said starting tubular metal blank by drawing the metal blank only partly through a contoured die or only partly through each one of a succession of contoured dies.

13. A method of making a contoured outer diameter of a metal ball bat, said method including the steps of: selecting a starting tubular metal blank; and reducing an outer diameter of essentially only a part of said starting tubular metal blank by drawing the metal blank only partly through each one of a succession of contoured dies by stopping a second drawing motion by sensing an increase to a drawing force developed when the contour of the die contacts the contour developed by the preceding die to thereby form a continuous smooth outside contour.

14. The method of according to claim 13 wherein said step of reducing an outer diameter of essentially only a part of said starting tubular metal blank includes stopping a first drawing motion by detecting a predetermined displacement of said starting tubular metal blank from the contour of the die.

15. A method of making a contoured outer diameter of a metal ball bat, said method including the steps of: selecting a starting tubular metal blank; and reducing an outer diameter of essentially only a part of said starting tubular metal blank by drawing the metal blank only partly through each one of a succession of contoured dies by stopping a first drawing motion by detecting a predetermined displacement of said starting tubular metal blank from the contour of the die.

16. The method of according to claim 15 wherein said step of reducing an outer diameter of essentially only a part of said starting tubular metal blank includes stopping a second drawing motion by sensing an increase to a drawing force developed when the contour of the die contacts the contour developed by the preceding die to thereby form a continuous smooth outside contour.

* * * * *